United States Patent [19]

Kobayashi

[11] Patent Number: 4,810,878

[45] Date of Patent: Mar. 7, 1989

[54] ION SOURCE FOR MASS SPECTROMETER

[75] Inventor: Tsutomu Kobayashi, Tokyo, Japan

[73] Assignee: Jeol Ltd., Tokyo, Japan

[21] Appl. No.: 184,198

[22] Filed: Apr. 21, 1988

[51] Int. Cl.[4] ..... H01J 49/04; H01J 49/10

[52] U.S. Cl. ..... 250/288; 250/423 R

[58] Field of Search ..... 250/288 A, 288, 423 R; 73/863.23, 863.41, 863.51

[56] References Cited

U.S. PATENT DOCUMENTS 4,055,987 11/1977 McFadden ..... 73/61.1
4,298,795 11/1981 Takeuchi et al. ..... 250/282
4,403,147 9/1983 Melera et al. ..... 250/288

FOREIGN PATENT DOCUMENTS 3028116 2/1982 Fed. Rep. of Germany ..... 250/288

*Primary Examiner*—Bruce C. Anderson
*Assistant Examiner*—Jack I. Berman
*Attorney, Agent, or Firm*—Webb, Burden, Ziesenheim & Webb

[57] ABSTRACT

There is disclosed an ion source for use in a mass spectrometer. The front end of an inlet tube carrying liquid sample reaches into the ionization chamber of the ion source, and is obstructed by a porous member. Sample injected into the porous member from the inlet tube passes through the porous member and exudes from its surface. Then, the sample evaporates into the ionization chamber. The vaporized sample is ionized by electron-impact ionization or chemical ionization.

6 Claims, 1 Drawing Sheet

ION SOURCE FOR MASS SPECTROMETER

BACKGROUND OF THE INVENTION

The present invention relates to an ion source for use in a mass spectrometer and, more particularly, to an ion source which can directly introduce liquid sample into the ionization chamber to ionize it by electron-impact ionization or chemical ionization.

Various systems have been heretofore proposed to introduce eluate from a liquid chromatograph into a mass spectrometer, for analyzing the eluate. For example, a system using a moving belt is disclosed in U.S. Pat. No. 4,055,987. A direct inlet system employing a nozzle is proposed in U.S. Pat. No. 4,298,795.

In the former system, column eluate is dropped onto a belt under atmospheric pressure and carried into the ionization chamber. The belt is heated to vaporize the solute, which is then ionized. This system needs a large-scale differential pumping system to permit the belt to be carried into the ion source. Further, it is difficult to eliminate a so-called memory effect due to residues on the belt.

In the latter system, a nozzle is used to directly spray column eluate into the ionization chamber. The vaporized solute is ionized. Since the nozzle is complex and delicate, it clogs easily. Hence, it is difficult to stably introduce the solute into the ionization chamber.

SUMMARY OF THE INVENTION

It is an object of the present invention to provide an ion source which is simple in structure and capable of stably introducing liquid sample into the ionization chamber, for ionizing the sample.

The ion source of the applicant's invention is a type of direct inlet system. In accordance with the invention, the front end of an inlet tube carrying liquid sample reaches into the ionization chamber but is sealed by a porous member. The sample passes through the porous member and exudes from the surface of the member. Then, the sample evaporates into the ionization chamber. The vaporized sample is ionized by electron-impact ionization or chemical ionization. Because the sample gradually enters the ionization chamber after passing through the porous member, and because it evaporates at a low rate, the sample can be stably introduced into the ionization chamber.

Other objects and features of the invention will appear in the course of the description thereof which follows.

DESCRIPTION OF THE PREFERRED EMBODIMENT

Figure 1:
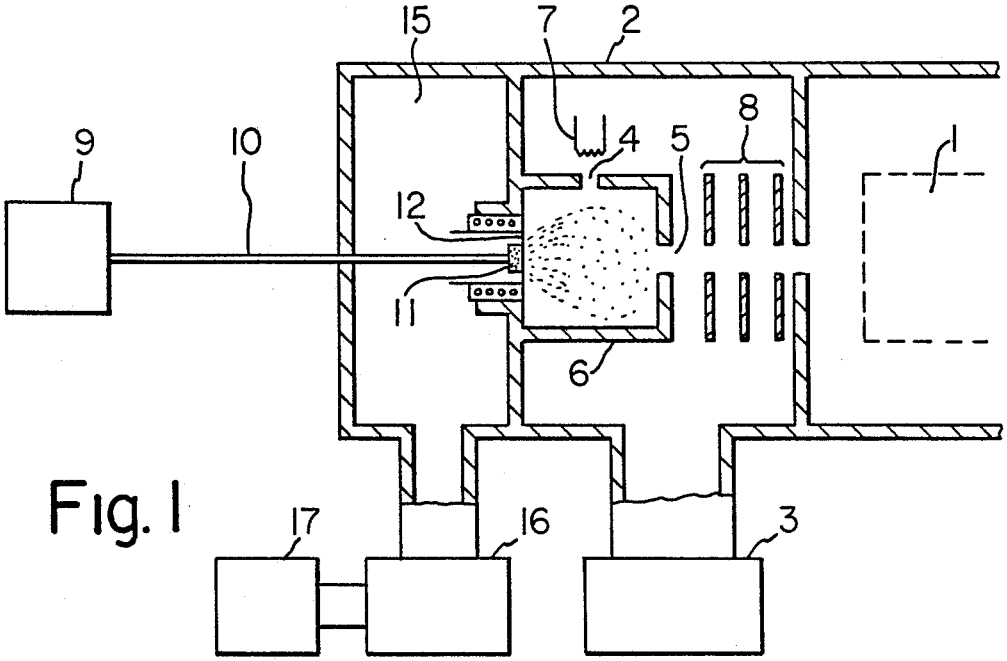
FIG. 1 is a schematic diagram of an ion source utilizing chemical ionization and built in accordance with the invention.

Referring to FIG. 1, there is shown an ion source utilizing chemical ionization. This source comprises a housing 2 the inside of which is evacuated by a vacuum pump 3. An ionization chamber 6 and a mass analyzer 1 are formed in the housing 2. A filament 7 and slit electrodes 8 for extracting, accelerating, and focusing the ions produced inside the chamber 6 are mounted in the housing 2. The ionization chamber 6 is provided with an entrance opening 4 for the electron beam and an exit opening 5 for the ion beam.

Eluate from a liquid chromatograph 9 is introduced into the ionization chamber 6 via an inlet tube 10. As an example, the tube 10 is made from fuzed silica, and has an inside diameter of about 50 $\mu$m.

Figure 2:
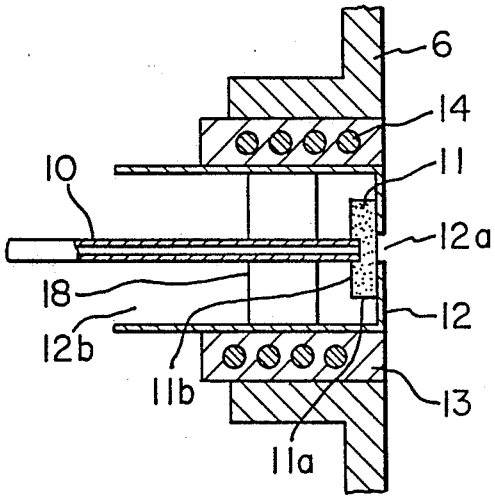
FIG. 2 is an enlarged cross section of the inlet tube-ionization chamber interface of the ion source shown in FIG. 1.

As shown in FIG. 2, a porous member 11 is mounted at the front end of the inlet tube 10 so as to obstruct its opening. Eluate channeled through the inlet tube 10 is injected into the porous member 11, and then it passes through the member and exudes from it. The porous member 11 consists of a chromatographic filter or frit fabricated by sintering powdered stainless steel, for example.

A cap 12 of stainless steel is placed over the porous member 11 and the inlet tube 10 so as to surround them. This cap 12 has an opening 12*a* that faces the ionization chamber. Eluate exuding from the porous member 11 enters the ionization chamber through this opening 12*a*. An anchor 18 is inserted in the cap 12 to center the inlet tube 10 in the cap. The space between the cap 12 and the surrounding wall is filled with an insulating cylinder 13 incorporating a heater 14.

Referring also to FIG. 1, the open end 12*b* of the cap 12 which faces away from the ionization chamber 6 is located inside an evacuation chamber 15. The inside of the evacuation chamber 15 is evacuated by a vacuum pump 17 which is connected into the evacuation chamber 15 via a flow control valve 16.

In the operation of the ion source constructed as described above, the eluate from the liquid chromatograph 9 is injected into the porous member 11 via the inlet tube 10. The eluate then flows through the porous member 11, and some of it exudes from the porous member 11 at the location of the opening 12*a* in the cap 12. The remaining portion of the eluate exudes from the other surfaces of the porous member 11, such as a side surface 11*a* and the rear surface 11*b*, and gathers inside the cap 12.

The eluate appearing from the opening 12*a* facing the ionization chamber evaporates and permeates the ionization chamber. Heating the porous member 11 with the heater 14 promotes the evaporization of the eluate.

The sizes of the entrance opening 4 and the exit opening 5 are appropriately set, taking into account the pumping speed of the vacuum pump 3, to maintain the pressure inside the ionization chamber 6 at a pressure suitable to chemical ionization, for example, about 1 torr. Under this pressure, the electrons emitted by the filament 7 are forced into the ionization chamber 6 through the entrance opening 4. The electrons primarily ionize the solvent accounting for a large proportion of the eluate. Then, the solvent ions undergo an ion-molecule reaction with the solute molecules, thus ionizing the vaporized solute. The resulting solute ions are taken out of the ionization chamber 6 through the exit opening 5. Subsequently, the ions are introduced into the mass analyzer 1, where they are analyzed.

Meanwhile, the eluate that slowly flows into the cap 12 also evaporates gradually, and is exhausted by the vacuum pump 17 via the flow control valve 16. A member which absorbs the eluate can be placed inside the cap.

In the above example, the eluate injected into porous member 11 from the inlet tube 10 is split into two parts, one of which passes into the opening 12*a* exposed to the ionization chamber 6, the other reaching the other portions inside the cap 12. Therefore, the porous member 11 functions as a splitter. Consequently, if the flow rate of eluate transported via the inlet tube 10 exceeds the exhaustion capacity of the ion source, the flow rate of eluate introduced into the ionization chamber 6 can be limited below that capacity. The flow rate of eluate admitted into the ionization chamber can be varied over a wide range by adequately setting the area of the opening 12*a*, the diameter, the thickness, or other dimension of the porous member 11.

Also, the flow rate of eluate introduced into the ionization chamber 6 can be changed by adjusting the pressure inside the evacuation chamber 15 with the valve 16. In particular eluate injected into the porous member 11 via the inlet tube 10 at a pressure of 2 to 3 atmospheres is split into two, one of which passes into the ionization chamber 6 retained at substantially zero atmospheres, the other moving into the evacuation chamber 15 that is kept at an intermediate pressure. Thus, the flow of eluate inside the porous member 11 is altered by appropriately adjusting the pressure inside the evacuation chamber 15. In this way, the flow rate of eluate introduced into the ionization chamber can be varied.

In the above example, the solvent included in the eluate is used as a reagent gas. Also, a distinct reagent gas may be introduced into the ionization chamber through an additional inlet tube. Where the pressure inside the ionization chamber becomes excessively high, the inside of the ionization chamber may be evacuated by an appropriate vacuum pump to maintain the pressure suitable for chemical ionization.

Further, in the above example, the ion source makes use of chemical ionization. The invention is also applicable to an ion source utilizing electron-impact ionization and to an ion source using a combination of chemical ionization and electron-impact ionization. Where electron-impact ionization is used, it is necessary to make lower the pressure inside the ionization chamber, for passing electrons through the ionization chamber.

In addition, any desired liquid sample other than eluate from a liquid chromatograph may be forced through the porous member and ionized, by connecting the inlet tube with an appropriate sample conveyance mechanism.

Having thus described my invention with the detail and particularity required by the Patent Laws, what is desired and claimed protected by Letters Patent is set forth in the following claims.

What is claimed is:

1. An ion source for a mass spectrometer comprising:

an ionization chamber;

a means for producing an electron beam and directing the beam into the ionization chamber;

a porous member having a surface facing the ionization chamber;

an inlet tube for injecting liquid sample into the porous member from outside to introduce the sample into the ionization chamber through the porous member, the sample evaporating from said surface of the porous member into the ionization chamber, the evaporated sample being ionized directly or indirectly by the electron beam; and a cover disposed so as to cover a portion of said surface of the porous member facing the ionization chamber, the cover having an opening defining a region from which the liquid sample exudes through said surface, and wherein the sample exuding from the surfaces of the porous member other than at said region is diverted from said ionization chamber.

2. An ion source for a mass spectrometer as set forth in claim 1, wherein the liquid sample comprises a solvent and the solvent upon vaporization acts as a reagent gas, and wherein the sample is ionized by chemical ionization making use of the reagent gas.

3. An ion source for a mass spectrometer as set forth in claim 1, wherein the liquid sample is ionized by electron-impact ionization.

4. An ion source for a mass spectrometer as set for in claims 1, 2 or 3, wherein the inlet tube is connected with a liquid chromatograph.

5. An ion source for a mass spectrometer as set forth in claims 1, 2 or 3, wherein an absorbing member is disposed inside the cover to absorb the sample diverted from said ionization chamber.

6. An ion source for a mass spectrometer as set forth in claim 4, wherein an absorbing member is disposed inside the cover to absorb the sample diverted from said ionization chamber.

* * * * *

UNITED STATES PATENT AND TRADEMARK OFFICE

CERTIFICATE OF CORRECTION

PATENT NO. : 4,810,878

DATED : March 7, 1989

INVENTOR(X) : Tsutomu Kobayashi

It is certified that error appears in the above-identified patent and that said Letters Patent is hereby corrected as shown below:

Title Page, after the Application No. and Filing date insert
--Foreign Application Priority Data
April 23, 1987 Japan 62-100599--.

Signed and Sealed this

Twenty-eighth Day of November 1989

*Attest:*

JEFFREY M. SAMUELS

*Attesting Officer* *Acting Commissioner of Patents and Trademarks*